US006398297B1

(12) United States Patent
Cantwell

(10) Patent No.: US 6,398,297 B1
(45) Date of Patent: Jun. 4, 2002

(54) COLLAPSIBLE ROCKING CHAIR

(76) Inventor: Robert R. Cantwell, 1304 Bald Hill Rd., Leslie, MO (US) 63056

( * ) Notice: Subject to any disclaimer, the term of this patent is extended or adjusted under 35 U.S.C. 154(b) by 0 days.

(21) Appl. No.: 09/874,521

(22) Filed: Jun. 4, 2001

Related U.S. Application Data

(63) Continuation-in-part of application No. 09/483,446, filed on Jan. 14, 2000, now abandoned.

(30) Foreign Application Priority Data

Oct. 4, 1999 (KR) ..... 99-21237

(51) Int. Cl.[7] ..... A47C 3/02

(52) U.S. Cl. ..... 297/33; 297/59; 297/133; 297/271.6

(58) Field of Search ..... 297/440.1, 440.11, 297/271.6, 271.5, 258.1, 133, 42, 45, 59, 33

(56) References Cited

U.S. PATENT DOCUMENTS

| | | | | |
|---|---|---|---|---|
| 304,435 | A | 9/1884 | Malick | 297/133 |
| 328,000 | A | 10/1885 | Brown | 297/133 |
| 647,171 | A | 4/1900 | Wiles | |
| 1,535,298 | A | 4/1925 | Drabinsky | |
| 4,047,753 | A | 9/1977 | Uchida | |
| 4,184,711 | A | 1/1980 | Wakimoto | 297/16 |
| 4,285,543 | A | 8/1981 | Clark | |
| 4,547,015 | A | 10/1985 | Wakimoto | 297/16 |
| 5,496,094 | A | 3/1996 | Schwartzkopf et al. | 297/45 |
| 5,678,890 | A | 10/1997 | Tenbroeck | |
| 5,702,152 | A | 12/1997 | Shaw | |
| 5,836,654 | A | 11/1998 | DeBellis et al. | |
| 5,975,626 | A | 11/1999 | Ayocock | 297/16.1 |
| 5,984,406 | A | 11/1999 | Lee | |
| 6,045,177 | A | 4/2000 | Grace | 297/45 |
| D432,325 | S | 10/2000 | Zheng et al. | D6/368 |
| D432,823 | S | 10/2000 | Zheng | D6/500 |
| D433,244 | S | 11/2000 | Zheng | D6/367 |
| D433,574 | S | 11/2000 | Zheng | D6/368 |
| 6,241,311 | B1 | 5/2001 | Zheng | 297/45 |
| 6,247,748 | B1 | 6/2001 | Zheng | 297/16.2 |
| 6,296,304 | B1 | 10/2001 | Zheng | 297/45 |
| 6,302,479 | B1 | 10/2001 | Zheng | 297/16.2 |

*Primary Examiner*—Milton Nelson, Jr.
(74) *Attorney, Agent, or Firm*—Larry B. Guernsey; Intellectual Property Law Offices

(57) ABSTRACT

A collapsible rocking chair (1), which collapses to a compact bundle, including a chair part (2) having a number of support frame members (F1–10) which are pivotally connected to connecting members (6), and a rocking part (4) including a pair of rocker members (38) and shoe members (26) which are fixed to the rocker members (38). The shoe members (26) are detachably connected to the connecting members (6) to form locking assemblies (50). The shoe member (26) include a housing (72), a receptacle (36) which receives the connecting member (6), and a retaining element (64) including at least one rotary element (66) which is rotatably mounted to the shoe member housing (72). The rotary element (66) rotates to engage a retaining slot (60) of the connecting member (6), thereby locking it in place.

A second embodiment includes an alternate locking assembly (86). The shoe members (26) each include a housing (72), and a retaining element (64) including a retaining tab (98) and flanges (94), which surround a slot (96). The slot (96) is configured to accept insertion of the bottom platform (90) of the connecting member (6). The retaining tab (98) is flexibly attached to the shoe housing (72) to allow deflection as the bottom platform (90) is being inserted into the slot (96), and is biased to return to an undeflected position after insertion, thereby preventing withdrawal of the connecting member (6).

22 Claims, 7 Drawing Sheets

COLLAPSIBLE ROCKING CHAIR

The following is a continuation-in-part of application Ser. No. 09/483,446 which was filed on Jan. 14, 2000, and is now abandoned, which has the same inventor.

BACKGROUND OF THE INVENTION (a) Field of the Invention

The present invention relates to a collapsible chair, more particularly, a collapsible rocking chair enabling a user to rest comfortably during leisure or outdoor activities.

(b) Description of the Related Art

Rocking chairs have been used for centuries as soothing furnishings in the homes of many people. The comfortable oscillating motion of a rocking chair has been a comfort to many people through the years. Rocking chairs have however fallen from favor among the general public in recent years perhaps due to several disadvantages associated with them. Rocking chairs are generally bulky and require a fair area of floor space to be useful since there must be enough room for the rockers, which generally extend laterally from the uprights. There must also be enough room provided for the body of the chair to describe an arc centered at the center of gravity point, without colliding with tables, and lamps and such. Generally, rocking chairs are bulky, and often heavy, since they must be provided with rockers sturdy enough to support the occupant's weight and the weight of the chair throughout the arc of travel of the chair. The attachment of the legs to the rockers must also be substantial enough to withstand the repeated stress of varying weight vectors as the angle of application of weight to the joints varies through the oscillation cycles.

It has been impractical therefore to devise a rocking chair that is convertible from a standing chair to a rocking chair, and further to a collapsible chair which can be conveniently disassembled and stored for future use or carried on trips for portable enjoyment. Certainly wooden chairs would present weight and sturdiness problems which make portable wooden rocking chairs impractical. With the use of lighter-weight materials such as aluminum tubing, chairs now can be made lighter and more portable, but the problems of bulk and large required usage space have still remained.

There have been several attempts to make removable rockers for use on stationary chairs, and even for folding lawn chairs and such. U.S. Pat. No. 4,126,353 to Clough shows a conversion unit for turning a stationary chair to a rocking chair. However the attachment mechanism for the chair legs is complex, involving the use of clamps and/or screws to make a secure join. Even these mechanisms are questionable as to their long term stability, and they do not lend themselves to easy attachment and removal, as would be desired in a convertible chair assembly.

U.S. Pat. No. 4,285,543 to Clark shows a rocker attachment for a stationary folding lawn chair, however, the attachment mechanism is a set of spring clips whose stability is questionable under the repeated stress of rocking oscillations.

U.S. Pat. No. 4,807,926 to Brunn discloses a folding rocking chair which is apparently not designed to be convertible, so that the chair could be used as a stationary chair if desired, although it does appear to be collapsible.

The rockers in U.S. Pat. No. 4,079,991 to Harris apparently are meant to attach to the chair legs by either a snap fit or by attaching with ties, both of which will not be secure during repeated usage.

U.S. Pat. No. 5,486,034 to Dalke shows a rocker apparatus which attaches to a conventional chair or crib. Once again the attachment mechanism seems complex and the strength of the join may not stand up to the stress of repeated use without slippage.

U.S. Pat. No. 5,660,431 to Leach discloses a rocker conversion for lawn-type chairs in which complex bolt mechanisms are used to attach the lawn chair to rockers. The mechanisms appear not to allow quick attachment and release, and the security of the join is also uncertain.

Similarly, U.S. Pat. No. 5,702,152 to Shaw, U.S. Pat. No. 5,839,781 to Knape and U.S. Pat. No. 5,833,307 to Leach all have rocker attachments which connect to conventional chairs, but which have similar disadvantages pertaining to complexity of mechanism, and/or security of join.

Any rocking chair's comforting effects are diminished when the rocking action is not smooth or is in any way irregular. Part of the psychological benefit of the rocking chair is that the regularity of motion and smoothness of its gliding sensation must be consistent. Any "hitches" in its operation will be noticed and can become a source of irritation during repeated use. Thus the security and soundness of the join to the chair legs plays a major part in the quality of the chair as a whole. If there is any play in the join with any of the legs, or a rattle or squeak produced while rocking, these can seriously affect the quality of the rocker. The quality of the attachment mechanism is therefore of major importance in a rocking chair of any variety.

Additionally, most collapsible chairs that are made for use in leisure or outdoor activities are uncomfortable, and collapsible chairs may not stand straight if the ground on which they stand is not level. Further, when a user is seated on the chair, the framework may be subject to excessive extension in its direction of deployment, resulting in breakage. This results because existing collapsible chairs have no means to limit excessive extension.

Thus there is a need for a convertible rocking chair which can be collapsed to compact dimensions for travel or storage, which can function as a conventional chair, but which can also be quickly and securely converted to a rocking chair when desired, and which has a very secure and sturdy attachment mechanism.

DISCLOSURE OF INVENTION

Accordingly, it is an object of the present invention to provide a chair which is convertible from a conventional chair to a rocking chair.

Another object of the invention is to provide a chair which can be easily and quickly collapsed into a compact configuration for storage or transport.

And another object of the invention is to provide a chair which has an attachment mechanism which provides a secure join with the chair legs, and that allows no slippage or rattling during operation.

Briefly, one preferred embodiment of the present invention is a collapsible rocking chair, which collapses to a compact bundle, including a chair part having a number of support frame members which are pivotally connected to connecting members, and a rocking part including a pair of rocker members and shoe members which are fixed to the rocker members. The shoe members are detachably connected to the connecting members to form a locking assembly. The shoe member include a housing, a receptacle which receives the connecting member, and a retaining element including at least one rotary element which is rotatably mounted to the shoe member housing. The rotary element rotates to engage the retaining slot of the connecting member, thereby locking it in place.

A second embodiment of the present invention is a collapsible rocking chair, which collapses to a compact bundle, including a chair part having a number of support frame members which are pivotally connected to connecting members, and a rocking part including a pair of rocker members and shoe members which are fixed to the rocker members. The shoe members are detachably connected to the connecting members to form a locking assembly. The shoe members each include a housing, and a retaining element including a retaining tab and flanges, which surround a slot. The slot is configured to accept insertion of the bottom platform of the connecting member. The retaining tab is flexibly attached to the shoe housing to allow deflection as the bottom platform is being inserted into the slot, and is biased to return to an undeflected position after insertion, thereby preventing withdrawal of said bottom platform of said connecting member.

An advantage of the present invention is that the chair easily disassembles and folds to a very compact shape.

Another advantage of the invention is the attachment mechanism is very sturdy and withstands repeated usage very well.

And another advantage of the invention is the attachment mechanism attaches and detaches very quickly, and provides a join that is secure and free from rattles when used.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The accompanying drawings provide a further understanding of the invention and, together with the Detailed Description, explain the principles of the invention. In the drawings.

DETAILED DESCRIPTION OF THE PREFERRED EMBODIMENTS

The present invention will be described in detail with reference to the accompanying drawings.

Figure 1:
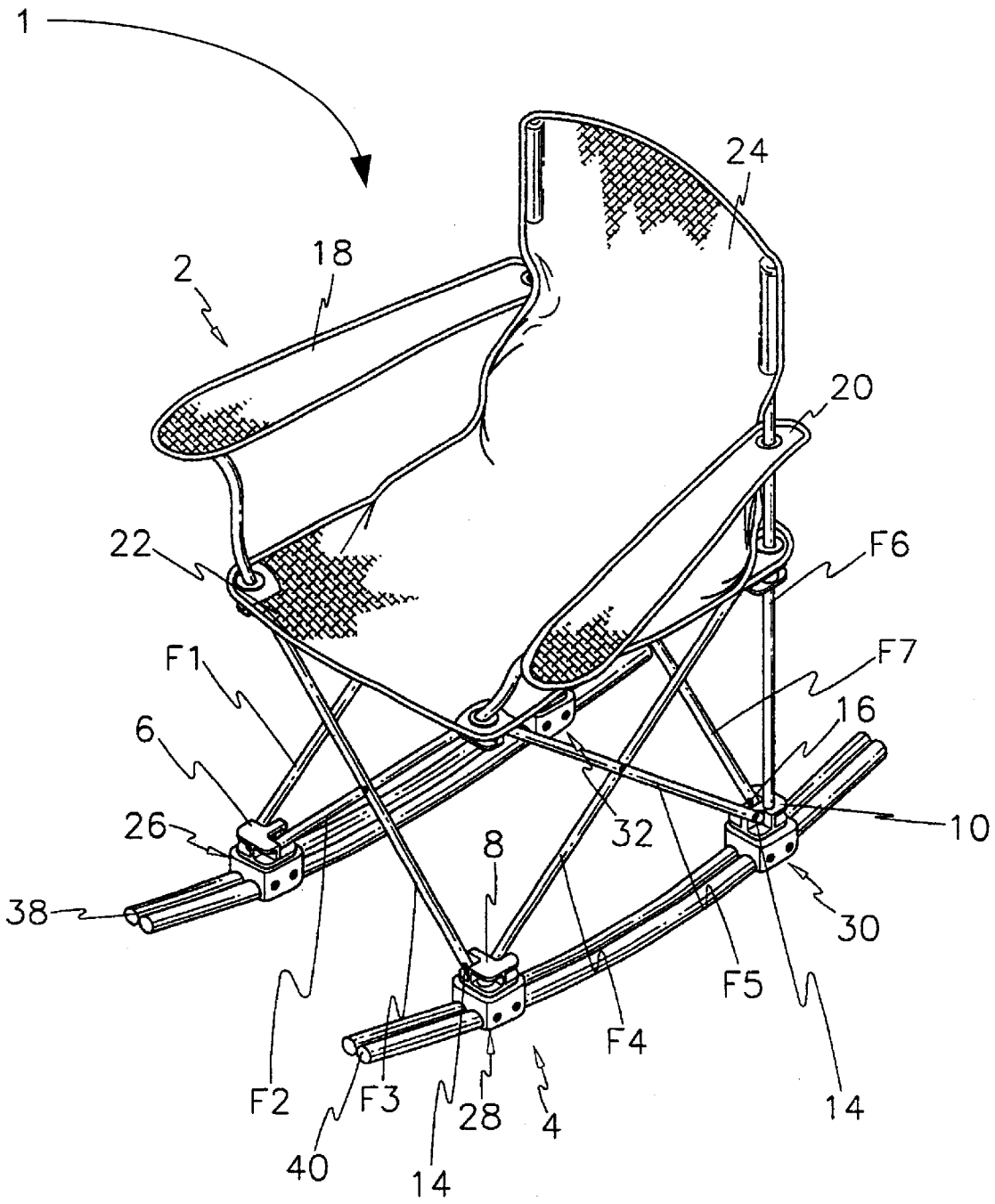
FIG. 1 is an isometric view of a collapsible rocking chair according to a preferred embodiment of the present invention.
Figure 2:
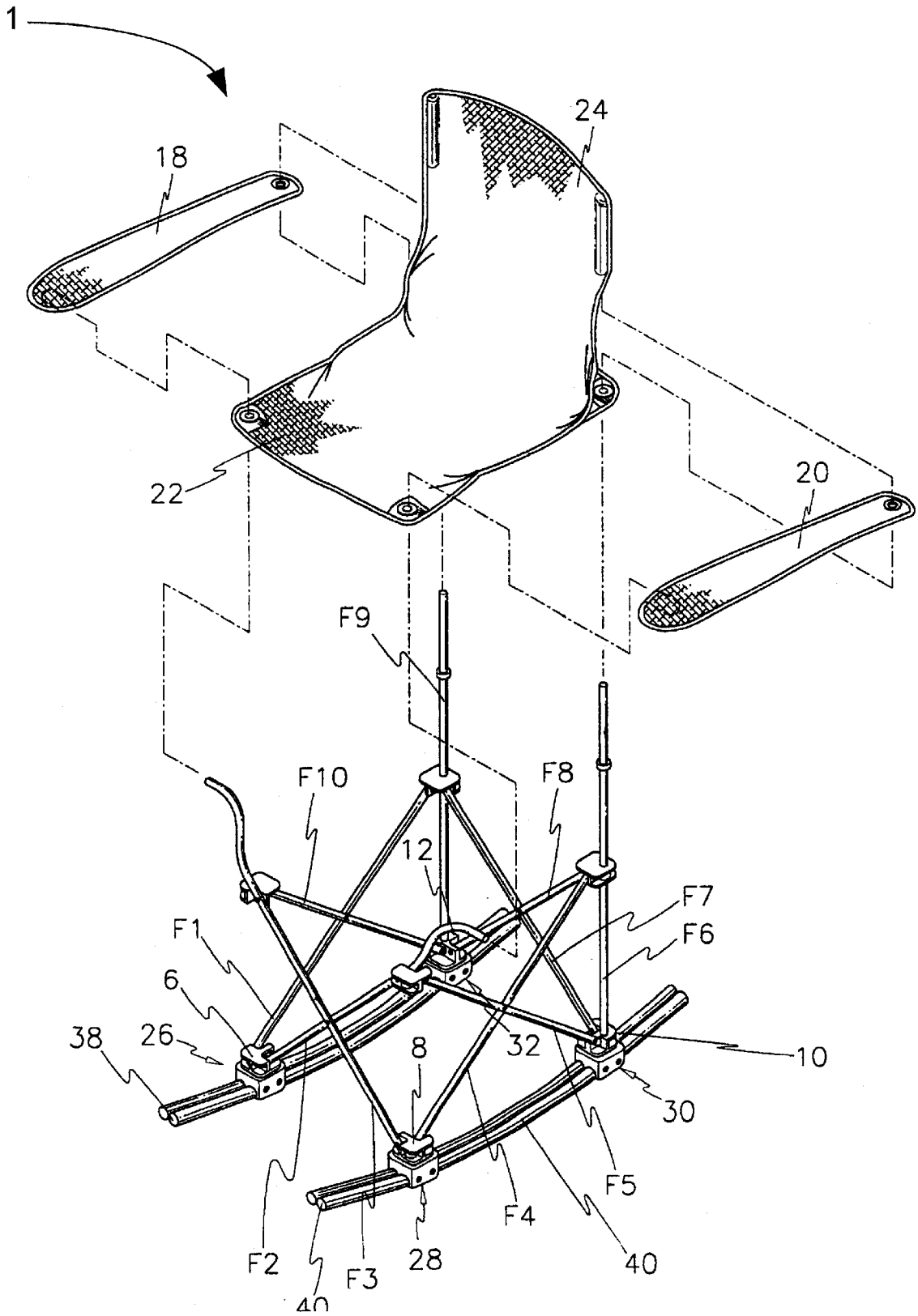
FIG. 2 is an exploded perspective view of the chair shown in FIG. 1.

Referring to FIGS. 1 and 2, a collapsible rocking chair 1 according to a preferred embodiment of the present invention comprises a chair part 2 and a rocking part 4, so that the chair part 2 and rocking part 4 are detachably connected to each other. The chair part 2 is provided with a framework having ten support frame members F1–F10, a seat 22, a back 24, arm rests 18 and 20, and four connecting members 6, 8, 10 and 12.

The support frame comprises four X-structures such that chair part 2 may be quickly deployed or folded for transporting. At the front, lower ends of a pair of support frame member sets F1, F2 and F3, F4 are hingedly coupled to the connecting members 6 and 8, respectively, to form a pair of front legs. At the rear, lower ends of a pair of support frame member sets F5, F7 and F8, F10 are hingedly coupled to the connecting members 10 and 12, respectively, and lower ends of a pair of straight support frame member sets F6 and F9 are fixed to the connecting members 10 and 12, respectively, to form a pair of rear legs. Specifically, each of the support frame members having an X-structure is pivotally coupled to each of the connecting members by pivot pins such as 14 or 16 as shown in FIG. 1. Accordingly, the support frame members are made inwardly foldable about a vertical axis passing through a center of the foldable chair. Upper ends of the support frames F3 and F2 support front sides of the armrests 18 and 20, respectively. The back sides of the armrest 18 and 20 are supported by the support frames F9 and F6, respectively. The six support frames F3, F2, F1, F7, F4 and F8 support the four comers of the seat 22, while the straight support frames F9 and f6 are extended to support the back 24. The description of the chair part 2 may also be modified to explain similar structures, and further descriptions thereof will not be made.

Hereinafter, explanation is made of a specific rocking part and its connection to the chair part according to the invention. This part provides support for the framework and is intended to allow the chair to rock forwardly or backwardly.

As described above, the chair part 2 and rocking part 4 are detachably connected to each other. This allows a compact bundle to be made of the chair for transporting, and it also allows for replacement of either the chair part 2 or the rocking part 4 if one part has been damaged.

Each rocking part 4 has a rocker member 38 (or 40) and a pair of shoe members 26, 32 (or 28, 30). Each of the shoe members 26, 32, 28 or 30 is coupled to each of the connecting members 6, 12, 8 or 10, respectively. Accordingly, the chair part 2 is detachably connected to the rocking part 4.

Figure 3:
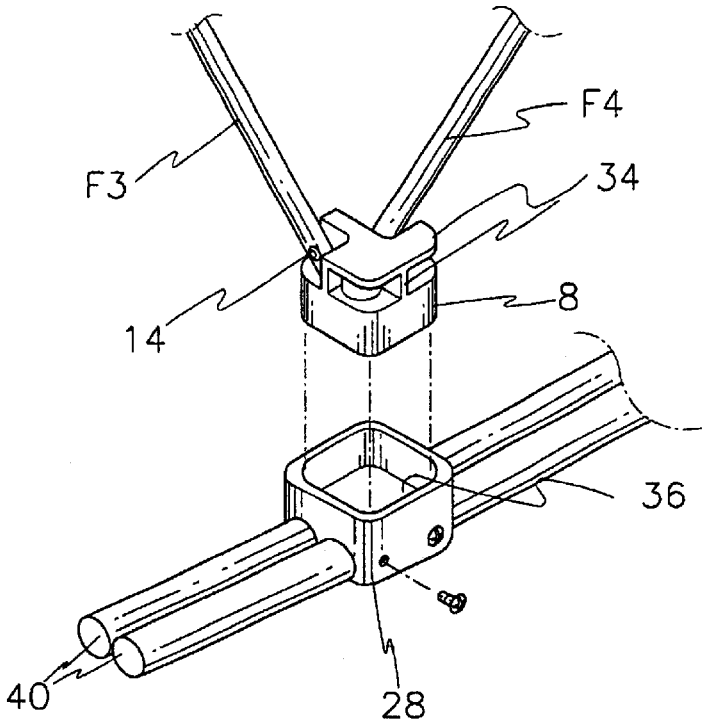
FIG. 3 is an enlarged and exploded perspective view illustrating a coupling of a rocker member and a shoe member.

Referring now to FIG. 3, all connecting members have a similar structure, so only connecting member 8 will be described. The connecting member 8 has an integrally formed rib 34 to which the support frame members F3 and F4 are pivotally coupled by a pivot pin 14. The connecting member may be formed in various sectional shapes such as rectangles, circles or ellipses. Accordingly, the shoe member 28 must have a receptacle 36 which has the same sectional shape as the shoe member, so that the connecting member 8 can be inserted into the receptacle 36 of the shoe member 28, thereby coupling the chair part 2 to the rocking part 4.

Figure 4:
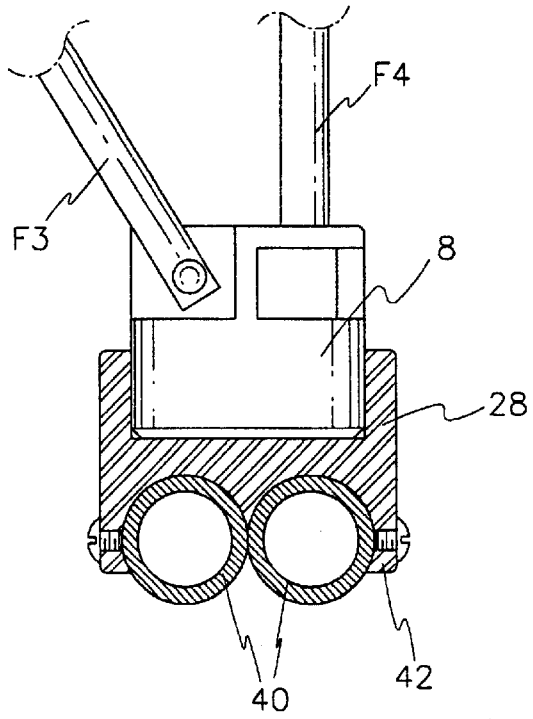
FIG. 4 is an enlarged sectional view illustrating a coupling of a rocker member and a shoe member.

FIG. 4 illustrates a coupling of the connecting member 8 and the shoe member 28. The shoe member 28 is also fixed to the rocker member 40 by a holder 42 and a bolt. Specifically, the shoe member 28 can be movable and it's position adjusted on the rocker member 40 before it is fixed in place by the bolt. Because the connecting members are inserted into the shoe members, the position of the support frame is constrained. Accordingly, the support frame cannot extend excessively, thereby avoiding chair damage.

The rocker member 38 can be formed by bending a tubular pipe or a strip of appropriate material. In a preferred embodiment, a rocker member is made of a pair of tubular pipes in order to enhance stability of the chair. Strip type rocker members are useful for increasing contact area with the ground. The shoe member 28 can be made of plastic or rubber while the rocker member 38 can be made of metal or wood.

The rocker member is arcuate, of which a center portion is allowed to protrude downwardly. Therefore, a user can rock the chair forwardly or backwardly. Accordingly, even when the chair is used on uneven ground, it adds stability and safety for any seated person. Although the drawings show that a pair of the rocker members 38, 40 are not connected to each other, it is possible to employ a transversal connector which connects them.

When a collapsible rocking chair according to the present invention is out of use, the chair part 2 is detached from the rocking parts 4. Specifically, the connecting members 6, 8, 10, and 12 are drawn out from the shoe members 26, 28, 30, and 32. Then the chair part 2 is collapsed to a compact bundle, and a user can carry the collapsed chair part with the rocking parts.

When the chair is to be used, the rocking parts are first placed in a desirable position, and the chair part is deployed. Then the user merely inserts the connecting members of the chair part into the shoe members of the rocking parts.

Figures 5, 6:
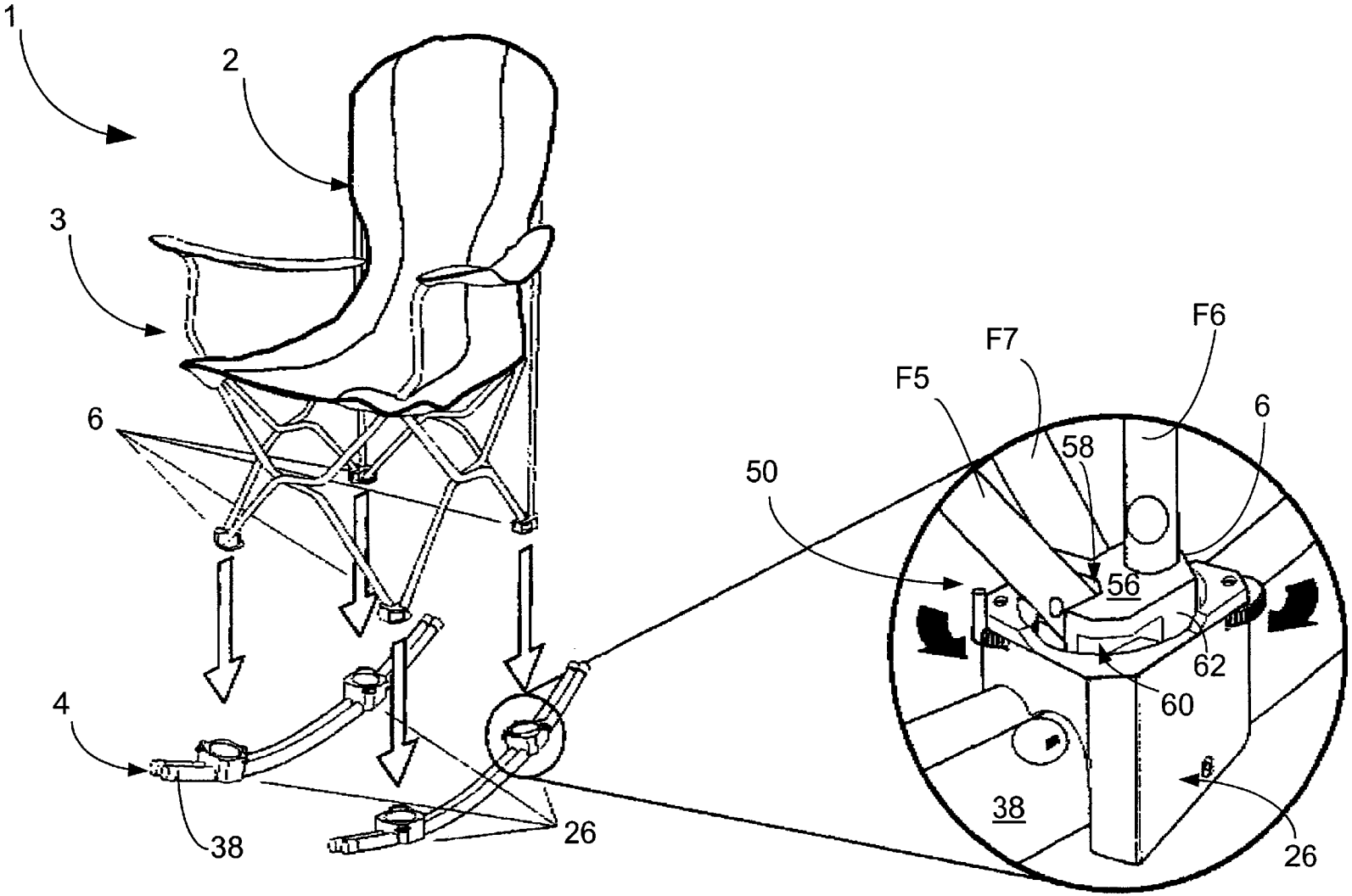
FIG. 5 is an isometric view of a chair part which is being attached to the rocker part.
FIG. 6 is a detailed view of the locking assembly of the chair part after it has been attached to the rocker part.

FIG. 5 illustrates an alternative embodiment of collapsible rocking chair 1, which includes a quick-release locking assembly 50, which holds the chair 2 firmly in contact with the rocker assembly 4. This quick-release locking assembly 50 has significant advances over the prior art, because it allows no slippage or rattle between the chair 2 and the rocker assembly 4. Slippage or rattle can easily become an annoyance for the user, as it breaks the rhythm of the rocking action, and disrupts the soothing effect for which the rocking chair is primarily used. In contrast, the present invention provides smooth, no-slip operation, yet still allows for quick detachment of the rocker assembly 4 from the chair 2, and easy collapsing of the collapsible rocking chair 1. For ease of reference, the connecting members shall be referred to collectively as element number 6, and the shoe members as element number 26.

The chair 2 is shown in its expanded configuration 3. Its compact configuration is not shown, but can be implemented by any number of well-known methods. The chair 2 has four connecting members 6 which engage four shoe members 26 which are included in the rocker assemblies 4 and mounted on the rocker rails 38. The engagement between the connecting members 6 and the shoe members 26 is very secure and stable, due to the locking mechanism, described below, which allows no irregularities that interrupt the smooth motion of the chair 1, and which causes problems for the prior art rocking chairs.

FIG. 6 illustrates a detail view of a connecting member 6 and a shoe member 26, after assembly, the connecting member 6 and shoe member 26 together making a locking assembly 50. The shoe member 26 is seen attached to rocker members 38, which in this case, is a pair of rails. This is not to be considered a limitation, and a single unitary rail may be used or greater multiples of rails beyond just two may also be used, with corresponding changes in the bottom of the socket assembly to interface with them properly.

The connecting member 6 has a number of attached frame members F5–F7, which preferably hinge to allow the chair 1 to fold to a compact shape 3. The connecting member 6 has a body 56, which has a number of grooves 58 into which the frame members F5–F7 are fitted and hinged. In this embodiment, the connecting member 6 includes a retaining slot 60 cut from the body side wall 62, into which a retaining element 64, (see FIG. 7, below) will fit.

Figure 7:
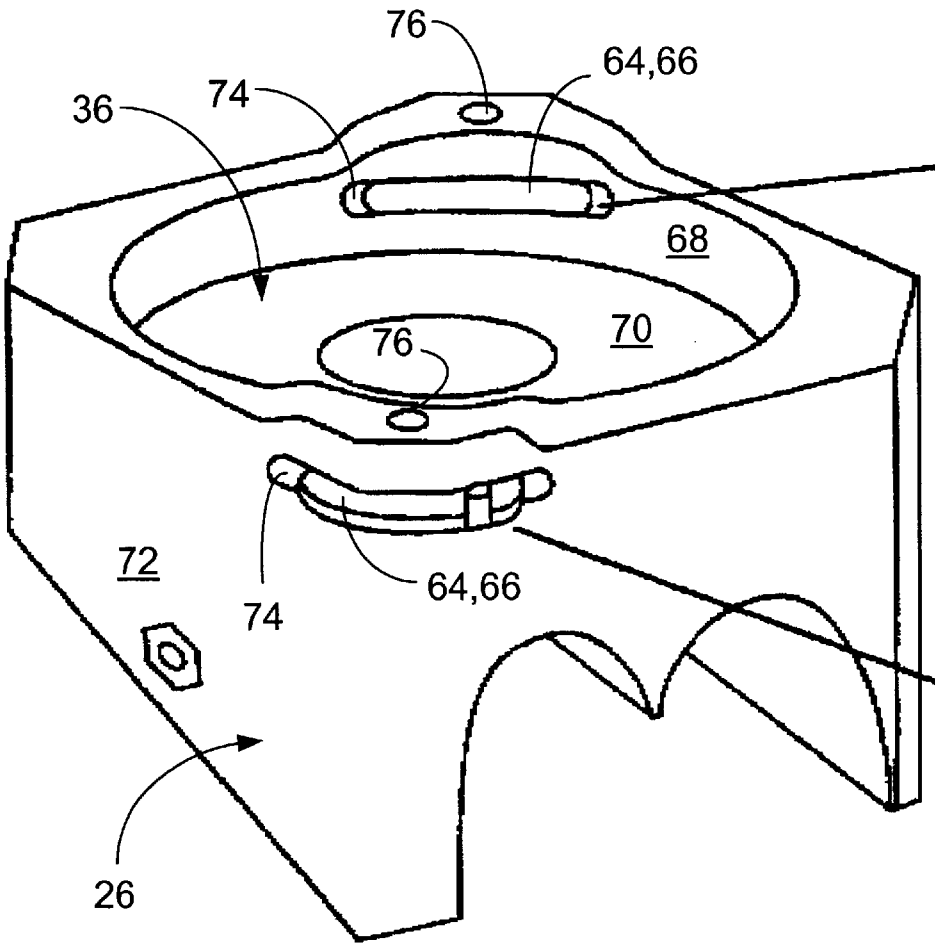
FIG. 7 is an isometric view of a shoe member which includes a rotary element locking mechanism.

FIG. 7 illustrates a detail perspective view of the shoe member 26, which has been detached from the rocker rails. It includes a housing 72 in which has been fashioned a receptacle 36, having side walls 68 and a receptacle bottom 70. There are two slots 74 in which two retaining elements 64 have been pivotally attached by two rotation axles 76. In this embodiment, the retaining elements 64 are actually rotary elements 66, of which there may be many variations. As shown, the retaining elements 64 may be a pair of elements which are placed opposing each other in the housing 72, but this is not a requirement.

Figure 8:
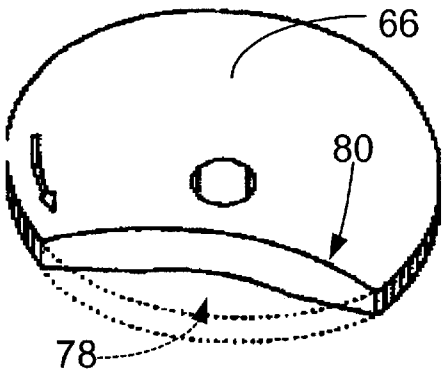
FIG. 8 is detail view of one variation of rotary element.
Figure 9:
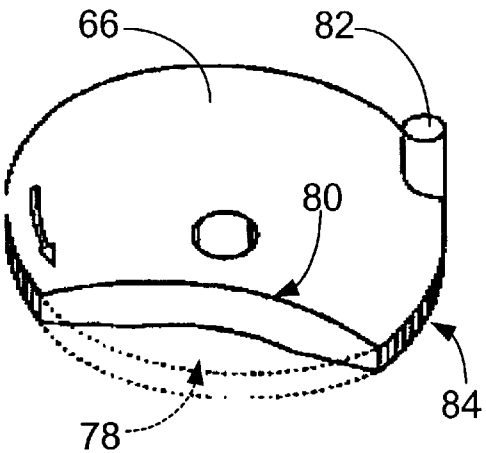
FIG. 9 is a detail view of a second variation in rotary element.

Two varieties of rotary elements 66 are shown in detail in FIGS. 8 and 9. Both are generally disk-shaped, and have a missing portion 78 which has been removed, shown in dashed lines. The outline 80 of the missing portion 78 roughly conforms to the curvature or outlines of the receptacle 36, and the outline of the overlapping portion of the connecting member 6, so that when the outline 80 is properly aligned with the curve of the receptacle 36, entrance to the receptacle 36 is unobscured by any portion of the rotary elements 66.

Referring now also to FIG. 6, the connecting member 6 is inserted into the receptacle 36 until it engages the receptacle bottom 70. The rotary elements 66 are then rotated about their rotation axles 76 until they engage the slots 60 in the body side wall 62, thus capturing the connecting member 6. This procedure is repeated for the remaining connecting members 6.

The rotary element 66 in FIG. 9 is fitted with a post 82 that is used to turn the rotary element 66, and additionally prevents the element 66 from rotating so that its missing portion becomes turned towards the outer comer, and becomes inaccessible to the user.

The rotary element 66 in FIG. 8 can alternately include a spring lock, which can bias the rotary element 66 to the engaged position, to insure that the connecting member 6 is retained. The rotary elements 66 can also optionally have notches 84 at the perimeter to aid in gripping the element 66 with the fingers.

Figure 10:
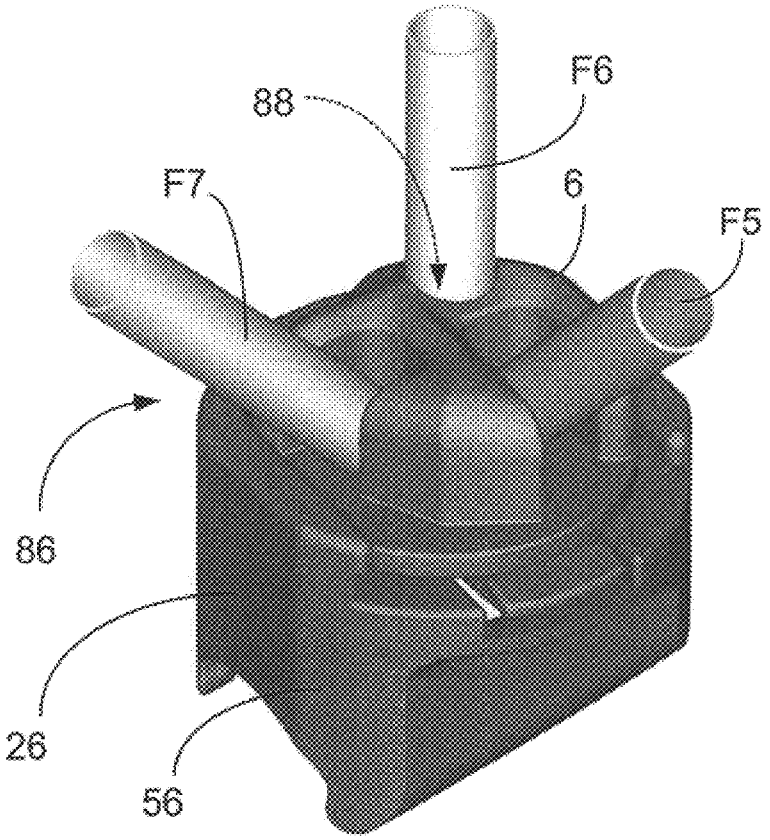
FIG. 10 is an isometric view of a second embodiment of locking assembly.
Figure 11:
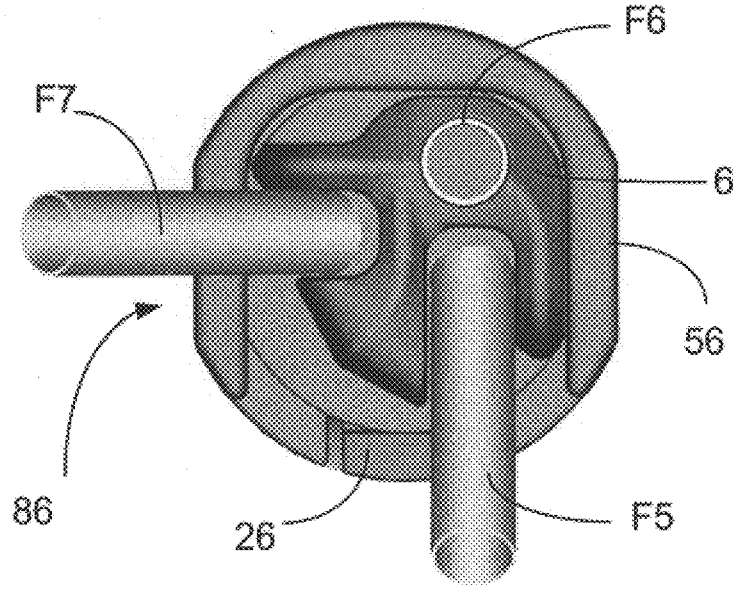
FIG. 11 is an top plan view of a second embodiment of locking assembly.
Figure 12:
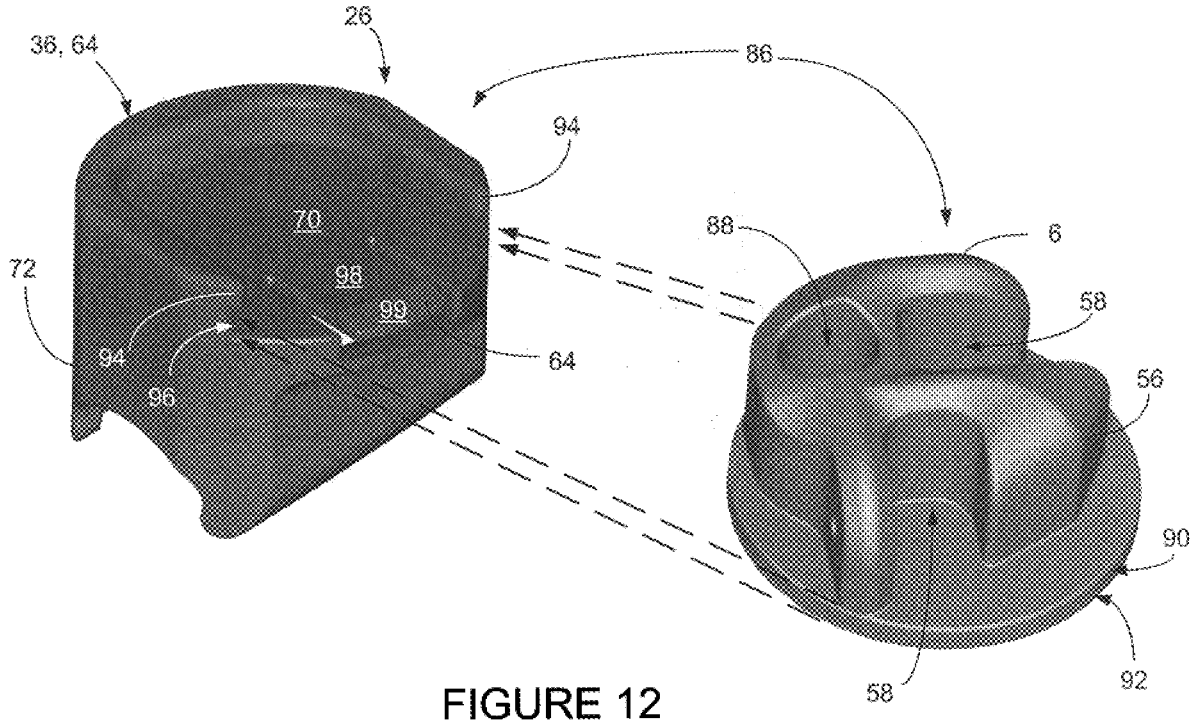
FIG. 12 is an isometric view of a connecting member and a shoe member, which are detached from the frame members, the rocker members and each other, with dashed arrows which indicate the direction of attachment.

FIGS. 10–12 show alternate embodiment of the locking assembly to that shown previously in FIGS. 6–9, and this alternative embodiment will be referred to as locking assembly 86. When elements correspond to those of the earlier embodiment, the same reference numbers will be used to refer to them. The locking assembly is shown removed from the rocker assembly for ease of viewing.

FIGS. 10 and 11 show connecting member 6 and shoe member 26 which are attached together to make the locking assembly 86. Frame members F5 and F7 are shown to be pivotally attached to the body 56, and F6 is inserted into a cavity 88 (see also FIG. 12) and is held in substantially vertical position.

FIG. 12 shows the connecting member 6 and shoe member 26 which have been detached from each other, with arrows and dashed lines showing the path of connection between the two members. The frame members have been removed for ease of observation, and the locking assembly 86 is again shown detached from the rocker assembly 4.

The connecting member 6 includes foot body 56, grooves 58, and cavity 88. It also includes a bottom platform 90, having a peripheral rim 92.

The shoe member 26 includes a receptacle 36, a housing 72, and a receptacle bottom 70. It also has flanges 94 which surround a slot 96, and a retaining tab 98, which acts as a retaining element 64. The retaining tab 98 is preferably separated from the housing 72 by slits, which free it to project in a cantilever fashion from the main housing 72. It is able to flex slightly, but the stiffness of the housing material biases it to return to its undeflected position, in the manner of a leaf spring. The retaining tab 98 preferably includes a lip 99, which projects a bit higher than the remainder of the retaining tab 98.

In operation, the connecting member 6 slides into the shoe member 26 receptacle 36. The rim 92 of the bottom platform 90 is inserted into the slot 96 of the receptacle 36. As the platform 90 moves into the slot 96, the lip 99 contacts the bottom of the platform 90, and is bent downward. When the bottom platform 90 has been completely inserted, the lip 99 is no longer depressed, and the retaining tab 98 springs back into its original position. The inner edge of the lip 99 then engages the rim 92 of the connecting member 6 and prevents it from sliding back out. The flanges 94 surround a portion of the upper surface of the bottom platform 90 and prevent the connecting member 6 from detaching vertically. The locking assembly 86 thus securely holds the connecting member 6 in contact with the shoe 26.

The retaining member 64, in this case the retaining tab 98, is released by pressing the lip 99 downward, so that that it no longer engages the rim 92 of the connecting member 6. The bottom platform 90 can then slide out of the slot 96.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

INDUSTRIAL APPLICABILITY

The present collapsible rocking chair 1 is well suited for application in the home, backyard, or on camping trips and picnics.

When the chair 1 is to be used, the rocking parts 4 are first placed in a desirable position, and the chair part 2 is deployed. Then the user merely inserts the connecting members 6 of the chair part 2 into the receptacle 36 of the shoe members 26 of the rocking parts 4 until it engages the receptacle bottom 70. The rotary elements 66 are then rotated about their rotation axles 76 until they engage the slots 60 in the body side wall 62, thus capturing the connecting member 6. This procedure is repeated for the remaining connecting members 6.

Alternately, the connecting member 6 slides into the shoe member 26 receptacle 36. The rim 92 of the bottom platform 90 is inserted into the slot 96 of the receptacle 36. As the platform 90 moves into the slot 96, the lip 99 contacts the bottom of the platform 90, and is bent downward. When the bottom platform 90 has been completely inserted, the lip 99 is no longer depressed, and the retaining tab 98 springs back into its original position. The inner edge of the lip 99 then engages the rim 92 of the connecting member 6 and prevents it from sliding back out. The flanges 94 surround a portion of the upper surface of the bottom platform 90 and prevent the connecting member 6 from detaching vertically. The locking assembly 86 thus securely holds the connecting member 6 in contact with the shoe 26.

The retaining member 64, in this case the retaining tab 98, is released by pressing the lip 99 downward, so that that it no longer engages the rim 92 of the connecting member 6. The bottom platform 90 can then slide out of the slot 96.

When a collapsible rocking chair 1 according to the present invention is out of use, the chair part 2 is detached from the rocking parts 4. Specifically, the connecting members 6, 8, 10, and 12 are drawn out from the shoe members 26, 28, 30, and 32. Then the chair part 2 is collapsed to a compact bundle, and a user can carry the collapsed chair part 2 with the rocking parts 4.

For the above, and other, reasons, it is expected that the collapsible rocking chair 1 of the present invention will have widespread industrial applicability. Therefore, it is expected that the commercial utility of the present invention will be extensive and long lasting.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A collapsible rocking chair, which collapses to a compact bundle, comprising:

a chair part including a plurality of support frame members which are pivotally connected to connecting members;

a rocking part including a pair of rocker members and shoe members being fixed to said rocker members;

each of said shoe members including a housing, a receptacle which receives said connecting member, and at least one retaining element which releasably engages a portion of said connecting member to lock it in place, said shoe members being detachably connected to said connecting members to form a locking assembly;

a portion of said connecting member surrounds a retaining slot; and said at least one retaining element includes at least one rotary element which is rotatably mounted to said shoe member housing, and which rotates to engage said retaining slot of said connecting member.

2. The collapsible rocking chair as recited in claim 1, wherein:

each of said shoe members is movable on said rocker member and fixed to said rocker member by a bolt.

3. The collapsible rocking chair as recited in claim 1, wherein:

each of said rocker members is formed by bending a member chosen from the group consisting of tubular pipes and strips.

4. The collapsible rocking chair as recited in claim 1, wherein:

said at least one rotary element includes at least one disk from which an area has been removed, said area corresponding to that area which overlaps with a portion of said connecting member which is to be inserted into said receptacle.

5. The collapsible rocking chair as recited in claim 1, wherein:

said at least one rotary element includes a post.

6. The collapsible rocking chair as recited in claim 1, wherein:

said at least one rotary element includes peripheral notches.

7. The collapsible rocking chair as recited in claim 1, wherein:

said at least one rotary element is a pair of rotary elements which are opposable placed in said shoe member.

8. The collapsible rocking chair as recited in claim 1, wherein:

said pair of rocker members are arcuate and protruding downwardly.

9. A collapsible rocking chair, which collapses to a compact bundle, comprising:

a chair part including a plurality of support frame members which are pivotally connected to connecting members;

a rocking part including a pair of rocker members and shoe members being fixed to said rocker members;

each of said shoe members including a housing, a receptacle which receives said connecting member, and at least one retaining element which releasably engages a portion of said connecting member to lock it in place, said shoe members being detachably connected to said connecting members to form a locking assembly;

said connecting member includes a bottom platform, which has a rim: and said retaining element includes a retaining tab and flanges, which surround a slot, said slot configured to accept insertion of said bottom platform of said connecting member, and said retaining tab configured to prevent withdrawal of said bottom platform of said connecting member.

10. The collapsible rocking chair as recited in claim 9, wherein:

said retaining tab is flexibly attached to said shoe member housing to allow deflection as said bottom platform is being inserted into said slot, and is biased to return to an undeflected position after insertion.

11. The collapsible rocking chair as recited in claim 10, wherein:

said retaining tab includes a lip which engages a portion of said bottom platform rim when said retaining tab has returned to the undeflected position.

12. The collapsible rocking chair as recited in claim 9, wherein:

each of said shoe members is movable on said rocker member and fixed to said rocker member by a bolt.

13. The collapsible rocking chair as recited in claim 9, wherein:

each of said rocker members is formed by bending a member chosen from the group consisting of tubular pipes and strips.

14. The collapsible rocking chair as recited in claim 9, wherein:

said pair of rocker members are arcuate and protruding downwardly.

15. A collapsible rocking chair, which collapses to a compact bundle, comprising:

a chair part including a plurality of support frame members which are pivotally connected to connecting members, each of said connecting members including a retaining slot;

a rocking part including a pair of rocker members and shoe members being fixed to said rocker members; and said shoe members being detachably connected to said connecting members to form a locking assembly, each of said shoe members including a housing, a receptacle which receives said connecting member, and at least one retaining element including at least one rotary element which is rotatably mounted to said shoe member housing, and which rotates to engage said retaining slot of said connecting member, thereby locking it in place.

16. The collapsible rocking chair as recited in claim 15, wherein:

said at least one rotary element includes a disk from which an area has been removed, said area corresponding to that area which overlaps with a portion of said connecting member which is to be inserted into said receptacle.

17. The collapsible rocking chair as recited in claim 16, wherein:

said at least one rotary element includes peripheral notches.

18. The collapsible rocking chair as recited in claim 16, wherein:

each of said shoe members is movable on said rocker member and fixed to said rocker member by a bolt.

19. The collapsible rocking chair as recited in claim 16, wherein:

said at least one rotary element includes a post.

20. A collapsible rocking chair, which collapses to a compact bundle, comprising:

a chair part including a plurality of support frame members which are pivotally connected to connecting members, said connecting member including a bottom platform, which has a rim;

a rocking part including a pair of rocker members and shoe members being fixed to said rocker members; and said shoe members being detachably connected to said connecting members to form a locking assembly, said shoe members each including a housing, and a retaining element including a retaining tab and flanges which surround a slot, said slot configured to accept insertion of said bottom platform of said connecting member, and said retaining tab being flexibly attached to said shoe housing to allow deflection as said bottom platform is being inserted into said slot, and being biased to return to an undeflected position after insertion, thereby preventing withdrawal of said bottom platform of said connecting member.

21. The collapsible rocking chair as recited in claim 20, wherein:

each of said shoe members is movable on said rocker member and fixed to said rocker member by a bolt.

22. The collapsible rocking chair as recited in claim 20, wherein:

said retaining tab includes a lip which engages a portion of said bottom platform rim when said retaining tab has returned to the undeflected position.

* * * * *